United States Patent [19]

Crowle

[11] Patent Number: 4,751,772

[45] Date of Patent: Jun. 21, 1988

[54] TWO PART WAIST BUCKLE WITH SNAP-FITTING RETENTION FEATURE

[75] Inventor: William G. Crowle, Deerfield, Ill.

[73] Assignee: Illinois Tool Works, Inc., Chicago, Ill.

[21] Appl. No.: 101,796

[22] Filed: Sep. 28, 1987

[51] Int. Cl.[4] ..... A44B 11/12

[52] U.S. Cl. ..... 24/170; 24/193

[58] Field of Search ..... 24/170, 191, 193, 179, 24/188, 585, 69 ST, 68 CD

[56] References Cited

U.S. PATENT DOCUMENTS

| | | | |
|---|---|---|---|
| 624,559 | 5/1899 | Spaulding | 24/170 |
| 749,953 | 1/1904 | Sourek | 24/170 |
| 1,313,210 | 8/1919 | Ross | 24/170 |
| 2,369,225 | 2/1945 | George | 24/193 |
| 3,626,556 | 12/1971 | Struck | 24/665 |

FOREIGN PATENT DOCUMENTS 990749 11/1980 United Kingdom .

*Primary Examiner*—Victor N. Sakran

*Attorney, Agent, or Firm*—J. P. O'Brien; T. W. Buckman

[57] ABSTRACT

An improvement in a buckle of a type comprising a body member and a latch member, which is pivotable in relation to the body member so as to open or close the buckle. A lock pin on one such member must be positively snapped into a lock recess in the other member to close the buckle. The lock pin must be positively snapped out of the lock recess to open the buckle. In a preferred embodiment, the lock pin is one of a pair of lock pins on the latch member, and the lock recess is one of a pair of lock recesses in the body member.

2 Claims, 1 Drawing Sheet

TWO PART WAIST BUCKLE WITH SNAP-FITTING RETENTION FEATURE

BACKGROUND OF THE INVENTION

This invention pertains to a buckle of a type used to fasten a belt for a backpack, a baby carrier, scuba diving gear, or another heavy load. Such a buckle may have other uses as well.

Typically, such a buckle comprises a body member and a latch member, a belt of webbing or other material being attachable to its one end to the body member and being attachable to its other end to the latch member. The belt may be permanently attached to the body member, as by means of stitching through overlapped layers of the belt, but adjustably attached to the latch member.

In a typical buckle such as shown in British Registered Design No. 990749, dated July 17, 1979, the body member has a generally rectangular frame with a belt attaching portion, a distal portion, and opposite side portions. Each of the side portions is provided with a shoulder spaced from the belt-attaching portion.

Typically, in such a buckle, the latch member has a generally rectangular outline with opposite side edges and is adapted to be attached to the other end of the belt. The latch member is shaped and dimensioned so as to be capable of being passed at least partly through the frame, between the belt-attaching end and the shoulders.

When so passed through the frame, the latch member is pivotable in relation to the frame such that the latch member engages the distal portion of the body member for closing the buckle and is pivotable oppositely to open the buckle. Typically, such a buckle is not very secure against becoming opened accidentally, unless the belt is tensioned.

In such a buckle, it is known to provide for slight interference between the latch member and the body member, particularly between the latch member and the side portions of the body member, so as to retard pivoting of the latch member in relation to the body member, whereby there is some security against the buckle becoming opened accidentally. However, such security is not sufficient, particularly in circumstances wherein a person, in putting on a backpack, a baby carrier, scuba diving gear, or another heavy load, and in attempting to fasten such a buckle at his or her waist, has begun to close the buckle but has not yet closed the buckle fully or has not yet placed much if any tension on the belt. In such circumstances, the buckle can be accidentally opened, even if there is slight interference between the latch member and the body member.

There has been a need, to which this invention is addressed, for an improvement in a buckle of the type noted above, whereby more security can be obtained in such circumstances.

SUMMARY OF THE INVENTION

It is a principal object of this invention to provide an improvement in a buckle of the type noted above.

In accordance with this invention, one of the body and latch members of such a buckle, preferably the latch member, is provided with a lock recess. Moreover, the other of the body and latch members, preferably the body member, is provided with a lock pin, which is adapted to be positively snapped into the lock recess as the latch member is pivoted to close the buckle and to be positively snapped out of the lock recess as the latch member is pivoted to open the buckle.

Preferably, the lock recess is one of a pair of lock recesses, one of which is provided along each of the side edges of the latch member, and the lock pin is one a pair of lock pins, one of which is provided on each of the side portions of the body member. If a pair of lock recesses and a pair of lock pins are provided, each of the lock pins is adapted to be positively snapped over one of the side edges into one of the lock recess as the latch member is pivoted to close the buckle, and each of the lock pins is adapted to be positively snapped over the same one of the side edges of the latch member and out of the same one of the lock recesses as the latch member is pivoted to open the buckle.

In contrast with such security as prior buckles of the type noted above can provide, positive snapping interaction between the lock recess or lock recesses and the lock pin or lock pins provides more security against the buckle becoming opened accidentally, particularly but not exclusively in circumstances wherein a person in putting on a backpack, a baby carrier, scuba diving gear, or another heavy load, is attempting to fasten such a buckle at his or her waist, and has begun to close the buckle but has not yet closed the buckle fully or has not yet placed much if any tension on the buckle.

These and other objects, features, and advantages of this invention will be better understood from the following description of a preferred embodiment of this invention, with reference to the accompanying drawings.

DETAILED DESCRIPTION OF PREFERRED EMBODIMENT

Figure 1:
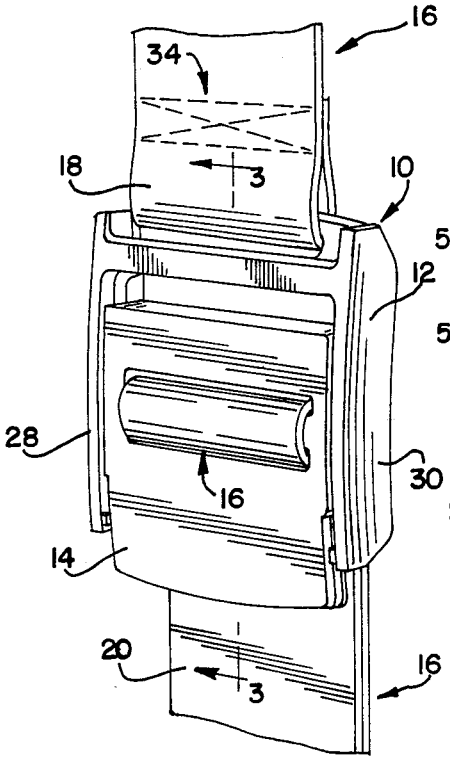
FIG. 1 is a perspective view of a closed buckle constituting a preferred embodiment of this invention, opposite ends of a belt being shown fragmentarily.

As shown in the drawings, a buckle 10 comprising a body member 12 and a latch member 14 is used with a belt 16 of webbing or other material. The belt 16 has opposite end portions 18, 20, which are attached respectively to the body member 12 and to the latch member 14, as described below. Although the drawings show the buckle 10 in a vertical orientation, its orientation is not critical. The buckle 10 may be rotated one-quarter turn for use at a person's waist.

The buckle 10 is similar to prior buckles of the type noted above in that the body member 12 has a generally rectangular frame 22 with a belt-attaching portion 24 adapted to be attached to the end portion 18 of the belt 16, a distal portion 26, and opposite side portions 28, 30. The belt-attaching portion 24 has a wide slot 32, through which the end portion 18 of the belt 16 is passed. The end portion 18 of the belt 16 is attached permanently to the belt-attaching portion 24 by stitching 34 forming a closed loop in the end portion 18 of the belt 16. One or more rivets (not shown) may be used in place of stitching.

Moreover, as in prior buckles of the type noted above, the body member 12 is provided on the side portion 28, with a shoulder 36 and, on the side portion 30, with a shoulder 38. The shoulders 36, 38, are spaced from the belt-attaching portion 24. Furthermore, the distal portion 26 has a serrated edge 40 for a purpose to be hereinafter described.

The buckle 10 is similar to prior buckles of the type noted above in that the latch member 14 has a generally rectangular outline with opposite side edges 42, 44, and is adapted to be attached to the end portion 20 of the belt 16. The latch member 14 has a pair of parallel slots 46, 48, through which the end portion 20 of the belt 16 is passed, as shown. So as to allow the belt 16 to be adjustable in its effective length, the belt 16 may include a free end (not shown) terminating the end portion 20. The serrated edge 40 of the distal portion 26 of the body member 12 helps to stabilize the end portion 20 of the belt 16 when the buckle 10 is closed in a manner to be hereinafter described. The latch member 14 is provided with a pair of pivot pins 50, 52, which extend respectively from the side edges 42, 44, at a flange 54 formed on the latch member 14.

Figure 2:
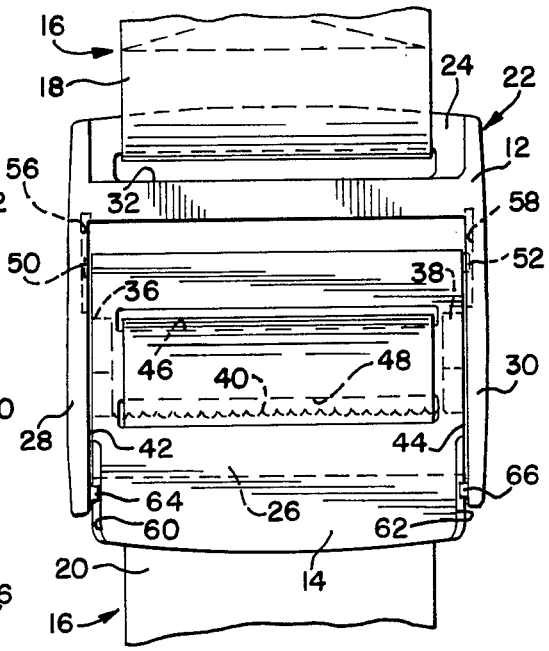
FIG. 2 is a front view of subject matter shown in FIG. 1.
Figure 3:
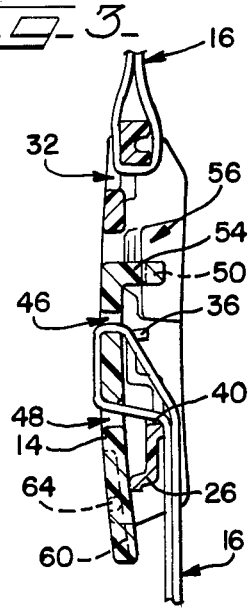
FIG. 3 is a cross-sectional view taken along line 3—3 of FIG. 1 in a direction shown by arrows.
Figure 4:
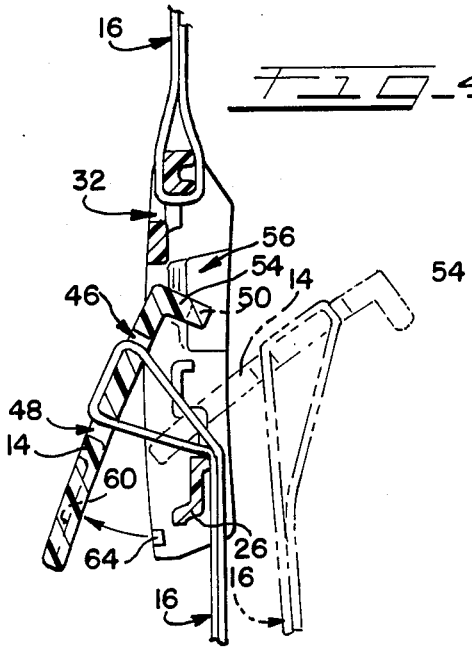
FIG. 4 is a cross-sectional view similar to FIG. 3 but with a latch member of the buckle being shown in successive stages in full lines and phantom lines as being separated from a body member of the buckle.

Moreover, as in prior buckles of the type noted above, the latch member 14 is shaped and dimensioned so as to be capable of passing through the frame 22, from the back of the frame 22 to the front of the frame 22, between the belt-attaching portion 24 and the shoulders 36, 38, except for the pivot pins 50, 52, which extend so as to be engageable with the respective side portions 28, 30, of the frame 22. FIG. 4 shows the latch member 14 having passed, through the frame, as mentioned above, from a position wherein the latch member 14 is shown in phantom lines. As shown in FIGS. 2 through 4, the side portion 28 is formed with a recess 56, which receives the pivot pin 50, and the side portion 30 is formed with a recess 58, which receives the pivot pin 52.

Thus, the latch member 14 is pivotable on the pivot pins 50, 52, in relation to the frame 22 in a pivotal sense, which is a counterclockwise sense with reference to FIGS. 3 and 4, (i.e., from the position wherein the latch member 14 is shown in full lines in FIG. 4 into the position wherein the latch member 14 is shown in FIG. 3) such that the latch member 14 engages the distal portion 26 of the body member 12, thereby to close the buckle 10. Also, the latch member 14 is pivotable on the pivot pins 50, 52, in an opposite sense, which is a clockwise sense with reference to FIGS. 3 and 4 (i.e., from the position wherein the latch member 14 is shown in FIG. 3 to the position wherein the latch member 14 is shown in full lines in FIG. 4), thereby to open the buckle 10. When the buckle 10 is closed, the flange 50 and the shoulders 36, 38, limit relative movement of the latch member 14 and the body member 12, in a translational sense, as the belt 16 is tensioned.

In prior buckles of the type noted above, it is known to provide for slight interference between the side edge 42 of the latch member 14 and the side portion 28 of the body member 12 and between the side edge 44 of the latch member 14 and the side portion 30 of the body memer 12, thereby to provide some security against the buckle 10 becoming opened accidentally. This invention does not require any provision for similar interference.

In accordance with a preferred embodiment of this invention, the latch member 14 is provided, along the side edge 42, with a lock recess 60, and along the side edge 44, with a lock recess 62. Furthermore, the body member 12 is provided, on the side portion 28, with a lock pin 64, and on the side portion 30, with a lock pin 66. The lock pin 64 is adapted to be positively snaped over the side edge 42 and into the lock recess 60 as the latch member 14 is pivoted to close the buckle 10. The lock pin 66 is adapted to be positively snapped over the side edge 44 and into the lock recess 62 as the latch member 14 is pivoted to close the buckle 10. The lock pin 64 is adapted to be positively snapped over the side edge 42 and out of the lock recess 60 as the latch member 14 is pivoted to open the buckle 10. The lock pin 66 is adapted to be positively snapped over the side edge 46 and out of the lock recess 62 as the latch member 14 is pivoted to open the buckle 10.

Once the lock pins 64 and 66 are brought into snapping interaction with lock recesses 60 and 62, respectively, the latch member 14 can be moved translationally of body member 12. It is noted that the length of lock recesses 60 and 62 is substantially the same as the length of recesses 56 and 58. This relationship permits the latch member 14 to be moved forwardly towards the distal portion 26 and thereby permits it to bring belt 16 into engagement with the serrated teeth 40.

Disengagement of belt 16 from serrated teeth 40 is readily accomplished by sliding latch member 14 away from distal portion 26 of body member 14. To complete the unlatching action, it is necessary to pull outwardly on the forward end of latch member 14 with sufficient force to cause locking pins 64, 66 to release their frictional grip with locking recesses 60 and 62, respectively. The latch member can then be opened by rotating it about pivot pins 50, 52 and withdrawing the latch member 14 from frame 22.

In contrast with such security as slight interference between the side edges 42, 44, of the latch member 14 and the side portions 28, 30 of the body member 12 can provide, positive snapping interaction between the lock pins 64, 66, provides more security against the buckle 10 becoming opened accidentally, particularly but not exclusively in circumstances discussed above.

Preferably, the body member 12 and the latch member 14 are injection-molded from an acetal resin, which is a hard, tough, and resilient engineering resin.

It is intended by the following claims to cover such modifications and improvements as come within the scope and spirit of the claims.

I claim:

1. An improvement in a buckle for use with a belt having opposite end portions, the buckle comprising a body member and a latch member;

said body member having a generally loop-shaped frame with a belt-attaching portion adapted to be attached to one of the end portions of said belt, opposite side portions, and a distal end portion to define a central opening; said body member having opposing shoulders formed inwardly of said central opening on said side portions equidistant from said belt-attaching portion and having a recess formed in said side portions inwardly of said central opening between said shoulders and said belt-attaching portion;

said latch member having a generally loop-shaped outline shaped and dimensioned to be capable of passing through said central opening of said body member, pair of pivot pins extending outwardly of the side edges of said latch member adjacent its rearward end portion for engagement with said opposing shoulders of said body member and in a pivotal and sliding relation with said pair of recesses in side portions of said body member; a pair of belt receiving slots formed between the forward and rearward end portions of said latch member such that the other of said end portions of said belt is adapted to be loosed therethrough and is adapted to engage said distal end portion of said body member upon said latch member being slid towards said distal end portion of said body member;

said improvement comprising one of said distal end portion of said body member and said forward end of said latch member is formed with a pair of lock recesses and the other is formed with a pair of lock pins, said pair of lock pins being adapted to be positively snapped into said pair of lock recesses in a sliding relationship as said forward end of said latch member is inserted through said central opening and is pivoted about said pair of lock recesses in said side members of said body member in order to close the buckle, wherein said pair of lock pins are adapted to be in a sliding relation with said pair of lock recesses to permit said latch member to be in a slidng relationship with said body member.

2. The improvement in a buckle as defined in claim 1, wherein said pair of lock recesses are formed along said side edges of said latch member at its forward end portion and said pair of locking pins are formed inwardly of said opposite side portions of said body member at its distal end portion, the spacing between said pair of lock pins being slightly less than the distance between said pair of lock recesses to provide a snap fitting relationship therebetween, and the length of said pair of lock recesses being substantially the same as said pair of recesses in said body member to permit said latch member to substantially be slid the length of said pair of recesses in said body member.

* * * * *